US010905939B2

(12) United States Patent
Matsui

(10) Patent No.: US 10,905,939 B2
(45) Date of Patent: Feb. 2, 2021

(54) SKATEBOARD DRIVEN WITH BOTH FEET

(71) Applicant: Yoshijiro Matsui, Fukui (JP)

(72) Inventor: Yoshijiro Matsui, Fukui (JP)

( * ) Notice: Subject to any disclaimer, the term of this patent is extended or adjusted under 35 U.S.C. 154(b) by 203 days.

(21) Appl. No.: 16/188,434

(22) Filed: Nov. 13, 2018

(65) Prior Publication Data

US 2019/0160365 A1 May 30, 2019

(30) Foreign Application Priority Data

Nov. 28, 2017 (JP) ..... 2017-228460

(51) Int. Cl.
*A63C 17/12* (2006.01)
*A63C 17/01* (2006.01)

(52) U.S. Cl.
CPC ..... *A63C 17/12* (2013.01); *A63C 17/01* (2013.01)

(58) Field of Classification Search
CPC ..... A63C 17/12; A63C 17/01
USPC ..... 280/221
See application file for complete search history.

(56) References Cited

U.S. PATENT DOCUMENTS 4,779,863 A * 10/1988 Yang ..... B62M 1/30 482/51
4,861,054 A * 8/1989 Spital ..... A63C 17/015 280/221
5,839,737 A 11/1998 Kruczek
6,007,074 A * 12/1999 Tarng ..... A63C 17/12 192/84.3
6,419,251 B1 7/2002 Chueh
6,572,128 B2 * 6/2003 Graf ..... B62K 3/002 280/221
8,899,605 B2 * 12/2014 Kim ..... B62M 1/30 280/257
2003/0098566 A1 * 5/2003 Christensen ..... B62K 3/002 280/221
2007/0114749 A1 * 5/2007 Tal ..... B62M 1/28 280/221
2010/0187790 A1 * 7/2010 Yu ..... B62M 1/28 280/221
2010/0207349 A1 * 8/2010 Chiu ..... B62K 3/002 280/221
2012/0248731 A1 10/2012 Li
2016/0045814 A1 2/2016 Zhou
2017/0369121 A1 * 12/2017 Blom ..... B62M 1/30

* cited by examiner

*Primary Examiner* — Tony H Winner
(74) *Attorney, Agent, or Firm* — Bacon & Thomas, PLLC

(57) ABSTRACT

A conventional skateboard driven by swinging a board with both feet like a seesaw has a great number of parts, is complicated and becomes heavy. Therefore, a light traveling performance is deteriorated. Further, increase of the parts number adversely affects a manufacturing cost. The invention employs a mechanism which can drive in a swinging board with the least parts structure. Further, a shape of the board on which both feet are got is formed into a so-called inverse gull-wing shape, thereby suppressing a ground height of a boarding surface. Further, a flexible motion performance can be achieved at a corner by the provision of a steering mechanism.

3 Claims, 3 Drawing Sheets

SKATEBOARD DRIVEN WITH BOTH FEET

TECHNICAL FIELD

The present invention relates to a skateboard which a rider drives with both feet.

BACKGROUND ART

A skateboard has been conventionally structured such that a rider gets one foot on a board and kicks the ground surface with the other foot, thereby traveling on the basis of inertia thereof. Thereafter, there has appeared a skateboard traveling by transmitting a motion of swinging the board with both feet like a seesaw to wheels by means of various mechanisms, and various types of skateboards have been proposed.

An advantage of these types exists in the swinging motion of the board according to movement of a body weight in addition to a muscle force of the rider, thereby traveling the skateboard for a long distance with less consumption of a physical strength in comparison with the conventional skateboard. However, these techniques still have an insufficient point in the light of a user.

Many of them have a great number of parts in comparison with an intended purpose and are complicated in their mechanisms. Therefore, a vehicle main body becomes heavy. As a result, a light traveling performance which is originally provided in the skateboard is deteriorated. Further, the increase of the parts number adversely affects a manufacturing cost.

CITATION LIST

Patent Literature

PATENT LITERATURE 1: U.S. Pat. No. 4,861,054
PATENT LITERATURE 2: U.S. Pat. No. 5,839,737
PATENT LITERATURE 3: U.S. Pat. No. 6,419,251 B1
PATENT LITERATURE 4: US 2012/0248731 A1
PATENT LITERATURE 5: US 2016/0045814 A1

SUMMARY OF INVENTION

Technical Problem

Consequently, in a skateboard driven with both feet according to the present invention, there is invented a mechanism which can drive wheels in a swinging board with the least parts structure. Accordingly, an object of the present invention is to provide a moving means which can lightly travel by sufficiently making good use of movement of a body weight of a rider.

Further, with regard to a shape of the board on which both feet are got, a cross sectional shape thereof is formed into a so-called inverse gull-wing shape in order to suppress a ground height as low as possible, and the shape of the board employs such a shape that a boarding surface is lower than a connection point between a frame and the board.

Further, an object of the present invention is to achieve a motion performance which is movable at a corner by adding a steering mechanism.

Solution to Problem

Accordingly, a technical solving means employed by the present invention is a skateboard driven with both feet, the skateboard including a main body frame of the skateboard, wheels which are attached to both ends of the frame, and a gear box which is provided at the center of the frame, wherein a board on which both feet are got is rotatably attached to a board support shaft which is provided in the gear box, two rotating shafts are provided in the gear box, two pulleys are attached side by side to each of the rotating shafts, a one-way clutch is pressed into between one of the two pulleys and the rotating shaft, right and left two pulley rows are formed by the two rotating shafts and the four pulleys, an endless belt attached to both ends of the board is wound around one pulley row of the two pulley rows so as to alternately draw an S-curve, and a different endless belt is wound around the other pulley row in the same rotating direction and is extended to a driven pulley attached to a drive wheel shaft so as to be wound around and closed.

Further, the skateboard driven with both feet is characterized in that a cross section in a longitudinal direction of the board is an inverse gull-wing shape having a dihedral angle.

Further, the skateboard driven with both feet is characterized in that the board support shaft is formed into a crisscross shape having a shaft which penetrates a center thereof, and steers the front wheels on the basis of displacement of the shaft caused by lateral inclination of the board.

Further, the skateboard driven with both feet is characterized in that board end pulleys are provided in both ends of the board, and the endless belt wound around the pulley row so as to draw the S-curve is wound around the board end pulleys and is thereafter attached to both ends of the frame.

Effect of Invention

As described above, according to the present invention, the wheels are driven by the simple parts structure on the basis of the swinging motion of the board caused by the body weight movement of the rider and the main body is light. As a result, the light motion performance which is inherently demanded in the skateboard can be provided. Further, the shape of the board on which the rider gets both feet thereof is formed into the so-called inverse gull-wing shape and has an effect of making the ground height low, thereby easily getting on the board. Further, a flexible motion performance can be achieved at the corner by setting the mechanism which steers the front wheels by inclining the board laterally while swinging.

DESCRIPTION OF EMBODIMENTS

Embodiment 1

Figure 1:
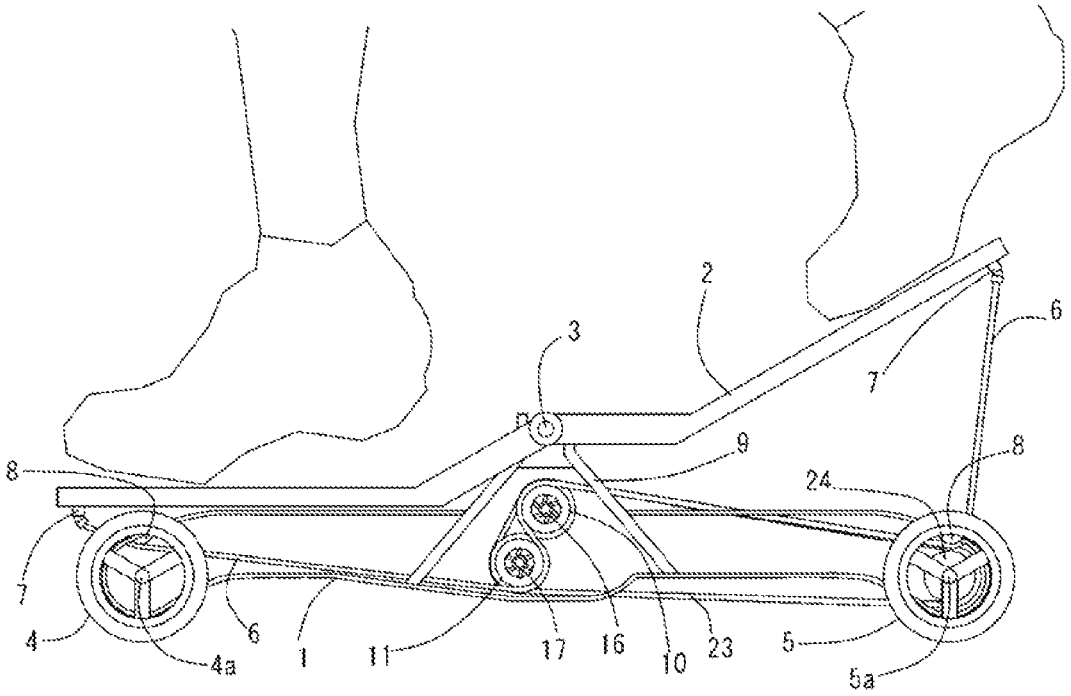
FIG. 1 is a side elevational view showing a first embodiment according to the present invention.
Figure 2:
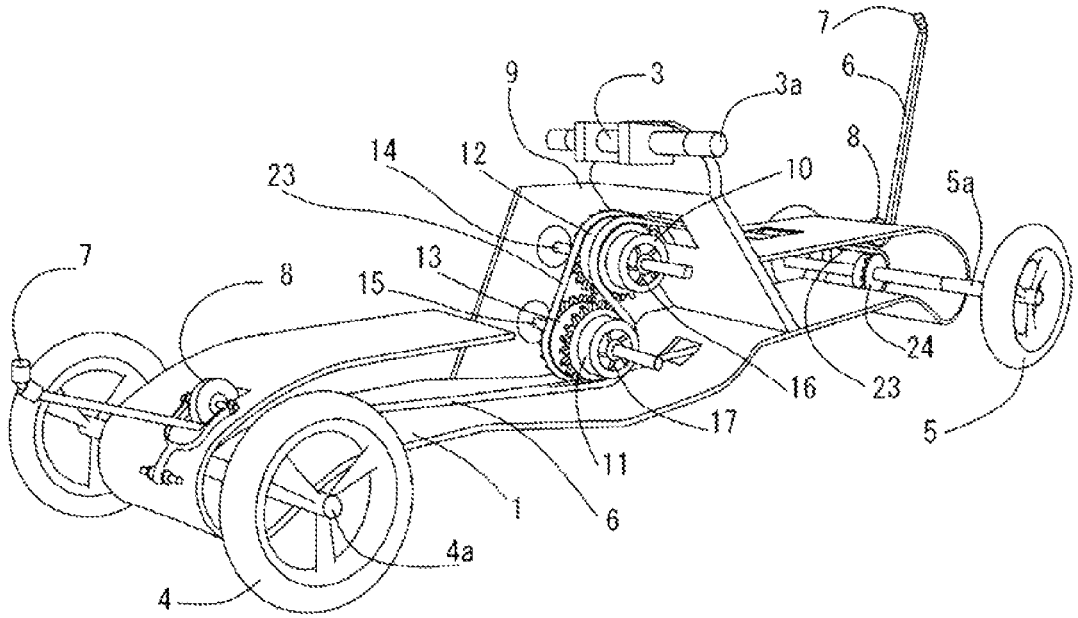
FIG. 2 is a perspective view showing the first embodiment according to the present invention.

A description will be given of a skateboard according to the present invention with reference to the accompanying drawings. FIG. 1 is a side elevational view of a skateboard which corresponds to a first embodiment according to the present invention, and FIG. 2 is a perspective view of the same. In FIGS. 1 and 2, reference numeral 1 denotes a frame of the skateboard. Rear wheels 5 serving as drive wheels and rear wheel shafts 5*a*, and front wheels 4 and front wheel shafts 4*a* are attached to wheel support portions in both ends of the frame 1 via bearings.

A gear box 9 (a front half thereof is omitted in FIG. 2 and is not illustrated) is provided in a center portion of the frame 1, a board support shaft 3 is attached to an upper portion of the gear box 9, and a board 2 (which is omitted in FIG. 2 and is not illustrated) on which a rider gets both feet is rotatably attached to both ends 3*a* of the board support shaft 3 via a bearing.

Figure 3:
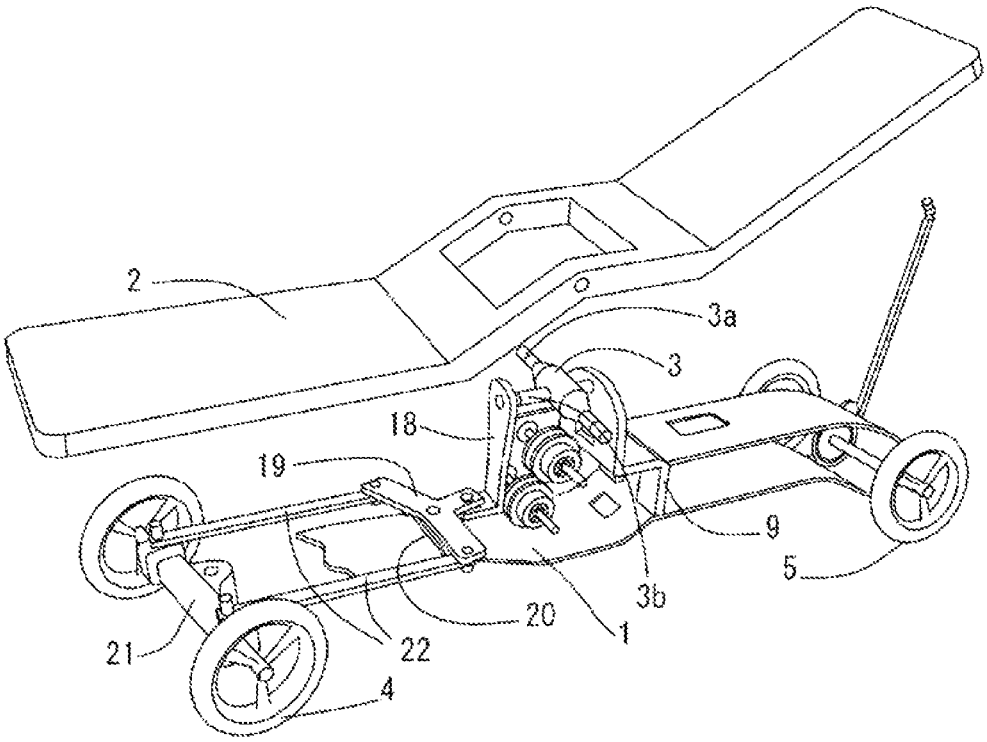
FIG. 3 is a perspective view showing a main part of a second embodiment according to the present invention.

The center portion of the board 2 has a great opening portion as shown in FIG. 3. This is provided for avoiding interference of the board 2 with the gear box 9 when the board 2 swings.

The board 2 is characterized in that a cross section thereof in a longitudinal direction is formed into a so-called inverse gull-wing shape with a dihedral angle obtained by elongating an English letter w laterally, and a position of a boarding surface of the board 2 is lower than a connection point between the board 2 and the board support shaft 3 on the basis of this shape, thereby easily getting on and off.

Further, on the basis of this specific shape, when knocking over one end, the other end is in a state of jumping up, so that it is possible to swing by continuously knocking over front and back.

An upper stage shaft 14 and a lower stage shaft 15 are rotatably attached appropriately via bearings in the gear box 9 in a parallel direction to the board support shaft 3. A floating pulley 10 is attached to the upper stage shaft 14 via a one-way clutch 16, and an upper drive pulley 12 is firmly fixed to just adjacently thereto. A floating pulley 11 is attached to the lower stage shaft 15 via a one-way clutch 17 so as to be aligned with the floating pulley 10, and a lower drive pulley 13 is firmly fixed to just adjacently thereto so as to be aligned with the upper drive pulley 12. Both of the one-way clutches 16 and 17 are attached in such a manner as to run idle when a rotating direction of an outer ring is a clockwise direction, and engage when the rotating direction is a counterclockwise direction.

In FIG. 1, universal joints 7 and 7 are attached to lower portions of both ends of the board 2, and an endless belt 6 is attached to a lower end of the universal joint 7 at the front end, is wound around a tension pulley 8 which is provided in a front portion of the frame 1 positioned below the endless belt, is thereafter guided into the gear box 9, is alternately wound to the floating pulley 11 and the floating pulley 10 so as to draw an S-curve, is taken out of the gear box 9, is thereafter wound to the tension pulley 8 which is provided in a rear portion of the frame 1, and is thereafter connected to the universal joint 7 which is provided upward at the rear end of the board 2. The two tension pulleys 8 and 8 mentioned above are a device for tensing the tension arranged endless belt 6 and preventing the endless belt 6 from being disconnected during motion. A driven pulley 24 attached to the rear wheel shaft 5*a* is on the same line as the upper drive pulley 12 and the lower drive pulley 13 within the gear box 9 and an endless belt 23 is wound around the driven pulley 24.

In FIG. 1, the rider puts both feet on the board 2 and swings both feet up and down in such a manner as to swing a seesaw. Then, the endless belt 6 reciprocates longitudinally while rotating the two floating pulleys 10 and 11 inversely each other within the gear box 9. When the rider knocks over a front side of the board 2, the endless belt 6 moves to a right side in the drawing, the floating pulley 10 rotates in the clockwise direction and the floating pulley 11 below the floating pulley 10 rotates in the counterclockwise direction.

At this time, the one-way clutch 16 pressed into between the upper floating pulley 10 and the upper stage shaft 14 runs idle without engaging, and the upper stage shaft 14 and the upper drive pulley 12 are accordingly in a free rotating state in the counterclockwise direction. The one-way clutch 17 pressed into between the lower floating pulley 11 and the lower stage shaft 15 engage each other, and the lower stage shaft 15 and the lower drive pulley 13 are driven in the counterclockwise direction, that is, in a forward moving direction. At the same time, the driven pulley 24 firmly fixed to the rear wheel shaft 5*a* is driven in the forward moving direction by using the upper drive pulley 12 which is wound linearly around by the endless belt 23 as an idler.

Next, when the rider knocks over the rear side of the board 2, the endless belt 6 moves to a left side in the drawing. In this case, the upper floating pulley 10 rotates in the counterclockwise direction, and the lower floating pulley 11 rotates in the clockwise direction. Consequently, the one-way clutch 16 pressed into between the floating pulley 10 and the upper stage shaft 14 engages, and the one-way clutch 17 pressed into between the lower floating pulley 11 and the lower stage shaft 15 runs idle. As a result, the upper stage shaft 14 and the upper drive pulley 12 are driven in the counterclockwise direction, that is, in the forward moving direction, and the driven pulley 24 is driven in the forward moving direction by using the lower drive pulley 13 which is firmly fixed to the lower stage shaft 15 in the counterclockwise freely rotating state as an idler.

The unintermitting motion of the endless belt 6 to the right and left sides on the basis of the seesaw movement of the board 2 as mentioned above sequentially drives and rotates without rest the upper drive pulley 12 and the lower drive pulley 13 which are attached to the upper stage shaft 14 and the lower stage shaft 15. As a result, the skateboard travels by driving the driven pulley 24 attached to the rear wheel shaft 5*a* in the forward moving direction.

The mechanism of changing the reciprocating motion of the endless belt 6 to one-way rotation of the driven pulley 24 can be established without being necessarily limited to the example mentioned above. For example, the one-way clutches 16 and 17 can be pressed into between the drive pulleys 12 and 13, and the upper and lower two shafts 14 and 15. In this case, the one way clutches are attached in an opposite engaging direction to the direction of the example of the floating pulleys 10 and 11 mentioned above, however, work in the same manner. Further, the one-way clutch may be pressed into between the upper stage shaft 14 and the floating pulley 10 and the one-way clutch may be pressed into between the lower stage shaft 15 and the lower drive pulley 13 according to an irregular way. In this case, the same results can be obtained and the same results can be obtained even by an exactly opposite structure to the above structure.

Figure 5:
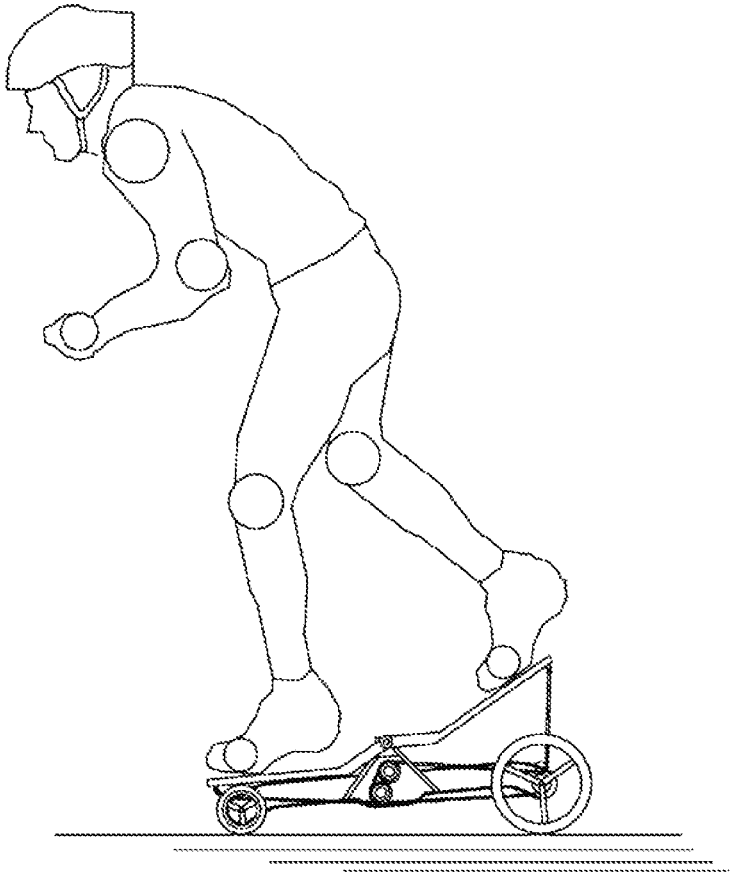
FIG. 5 is a view showing a traveling state in which drive wheels are enlarged their diameters on the basis of the first embodiment according to the present invention.

FIG. 5 shows a state of traveling by making a diameter of the rear wheel larger for speeding up, on the basis of the first embodiment according to the present invention.

Embodiment 2

Next, a description will be given of a second embodiment with reference to FIGS. 3 and 4. These drawings are shown in a state in which the board 2 is detached upward, for convenience of description. In the first embodiment, the board support shaft 3 is fixed to the gear box 9. In the second embodiment, the board support shaft 3 is formed into a crisscross shape having a shaft 3*b* penetrating a center thereof, the board 2 can be inclined in a lateral direction in addition to the swinging motion in the longitudinal direction, by rotatably attaching the shaft 3*b* in the longitudinal direction of the gear box 9 via a bearing, thereby steering the front wheels on the basis of displacement thereof via a link mechanism.

Figure 4:
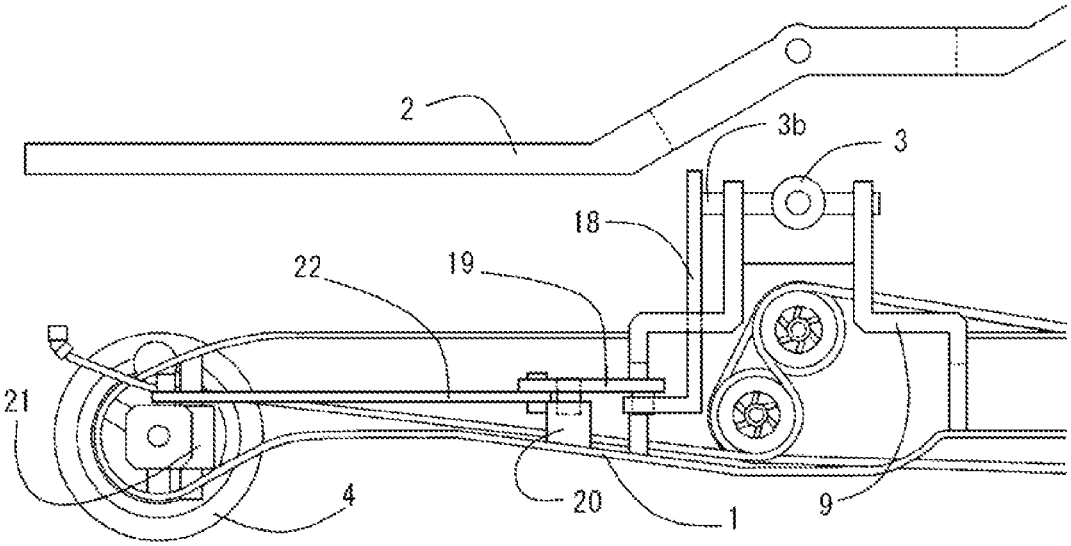
FIG. 4 is a side elevational view showing the main part of the second embodiment according to the present invention.

In FIGS. 3 and 4, a steering lever 18 is firmly fixed to the shaft 3*b* penetrating the board support shaft 3 which is protruded out of the bearing box 9, and is formed its lower end into a tip-split bifurcated shape, and a pin protruding out of a rear end of a link arm 19 is fitted to the lower end. A center shaft of the link arm 19 is rotatably fitted to a rink arm base 20 which is attached to the frame 1. A front wheel shaft box 21 is rotatably installed its center shaft to a front end of the frame 1, and the rink arm 19 and pins in both ends of the front wheel shaft box 21 are coupled by a link bar 22.

In FIG. 3, the rider travels by swinging the board 2 with both feet. When the rider comes to a corner during the traveling, the rider banks the board 2 to a direction to intend to turn, to a leftward direction in this case. Then, the displacement steers the front wheel shaft box 21 leftward via the shaft 3*b*, the steering lever 18, the link arm 19 and the link bar 22, and the front wheels 4 are going to turn leftward.

Embodiment 3

Figure 6:
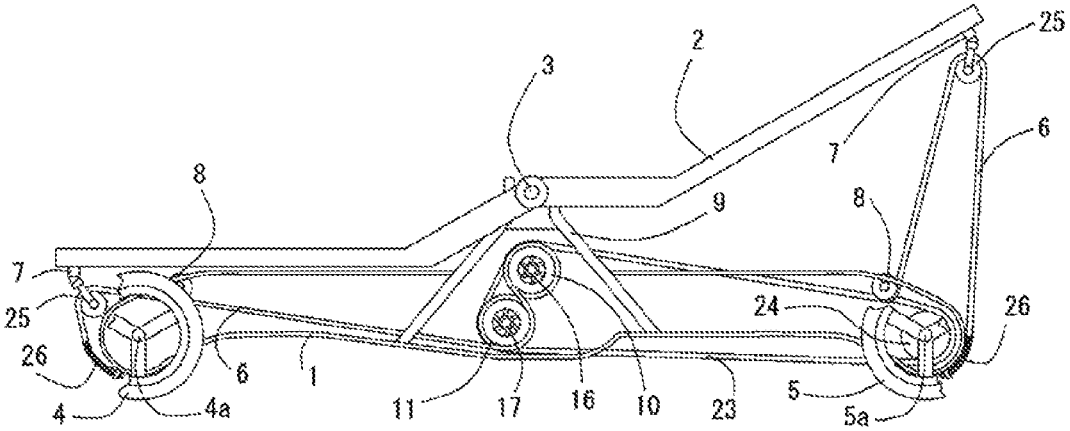
FIG. 6 is a side elevational view showing a third embodiment according to the present invention.

Next, a description will be given of a third embodiment with reference to FIG. 6. In the third embodiment, the endless belt 6 is alternately wound around the floating pulleys 10 and 11 in the same manner as the first embodiment. Differently from the first embodiment, the endless belt 6 is attached to both ends of the frame 1 via tension springs 26 and 26 after being wound around board end pulleys 25 and 25 which are provided in both ends of the board 2 via universal joints 7 and 7. Here, the tension springs 26 and 26 are a device for keeping a stable motion of the endless belt 6 together with the tension pulleys 8 and 8.

In this embodiment, when the rider knocks over and swings the board 2, the endless belt 6 moves forward and backward at a length which is twice a vertical moving stroke achieved by the board end pulley 25. More specifically, the board end pulley 25 serves as a moving pulley. As a result, an amount of rotation of the pulley rows 10 and 11 is increased in response thereto, and an amount of rotation of the driven pulley 24 is also increased. As a result, the skateboard can travel for a longer distance only by one knocking motion.

REFERENCE SIGNS LIST

1: frame
2: board
3: board support shaft
4: front wheel
5: rear wheel
6: endless belt
9: gear box
10: floating pulley
11: floating pulley
12: upper drive pulley
13: lower drive pulley
14: upper stage shaft
15: lower stage shaft
24: driven pulley
25: board end pulley
26: tension spring

The invention claimed is:

1. A foot-powered skateboard, the skateboard comprising:
a main body frame of the skateboard;
wheels which are attached to both ends of the frame; and
a gear box which is provided at a center of the frame,
wherein a foot board is rotatably attached to a board support shaft which is provided in the gear box, two rotating shafts are provided in the gear box, two pulleys are attached side by side to each of the rotating shafts, a one-way clutch is pressed into between one of the two pulleys and each of the rotating shafts, right and left two pulley rows are formed by the two rotating shafts and the four pulleys, a first endless belt attached to both ends of the board is wound around a first pulley row of the two pulley rows in a rotating direction so as to alternately draw an S-curve, and a second endless belt is wound around a second pulley row of the two pulley rows in the rotating direction and is extended to and wound around a driven pulley attached to a drive wheel shaft.

2. The foot-powered skateboard according to claim 1, wherein a cross section in a longitudinal direction of the board is an inverse gull-wing shape having a dihedral angle.

3. The foot-powered skateboard according to claim 1, wherein the endless belt is a roller chain.

* * * * *